United States Patent [19]

Lindblom, Jr.

[11] 4,453,532

[45] Jun. 12, 1984

[54] WATER HEATER FOR USE IN FIREPLACE

[76] Inventor: Fritz Lindblom, Jr., 733 El Rancho Rd., Santa Barbara, Calif. 93108

[21] Appl. No.: 263,485

[22] Filed: May 14, 1981

Related U.S. Application Data

[63] Continuation of Ser. No. 59,686, Jul. 23, 1979, abandoned.

[51] Int. Cl.[3] ..... F24B 9/04

[52] U.S. Cl. ..... 126/132; 126/143; 237/51

[58] Field of Search ..... 126/120, 121, 129, 131, 126/132, 133, 143, 164, 5; 165/168; 237/19, 51

[56] References Cited

U.S. PATENT DOCUMENTS

| | | | |
|---|---|---|---|
| 1,432,551 | 10/1922 | Harper | 126/132 |
| 2,991,543 | 7/1961 | Heuer et al. | 165/168 |
| 3,394,697 | 7/1968 | Lewis | 126/132 |
| 3,965,886 | 6/1976 | Nelson | 126/121 |
| 4,058,107 | 11/1977 | Edwards | 126/132 |
| 4,180,053 | 12/1979 | Patel | 126/132 |

FOREIGN PATENT DOCUMENTS

| | | | |
|---|---|---|---|
| 2398973 | 2/1979 | France | 126/132 |
| 999335 | 7/1965 | United Kingdom . | |

*Primary Examiner*—Samuel Scott
*Assistant Examiner*—Lee E. Barrett

[57] ABSTRACT

A water heater for use in a fireplace includes a heat exchanger which sits in the fireplace behind the fire. The top portion of the heat exchanger is surrounded by but spaced from a removable hood-like heat trap which does not open directly into the chimney. The heat trap captures the hot air rising from the fire and confines it to flow rearwardly over the top of the heat exchanger and then downwardly along the rear side of the heat exchanger. The hot air then escapes under the lower edge of the skirt of the heat trap and is drawn up the chimney. In an alternative embodiment, the heat exchanger extends horizontally in a plenum under the fire. In other embodiments, an auxiliary fan is used to move the air through passages adjacent a heat exchanger.

4 Claims, 10 Drawing Figures

20
18
16
46
2
14
48
39
44
34
36
39
16
39
2
42
10
38
12
36
39

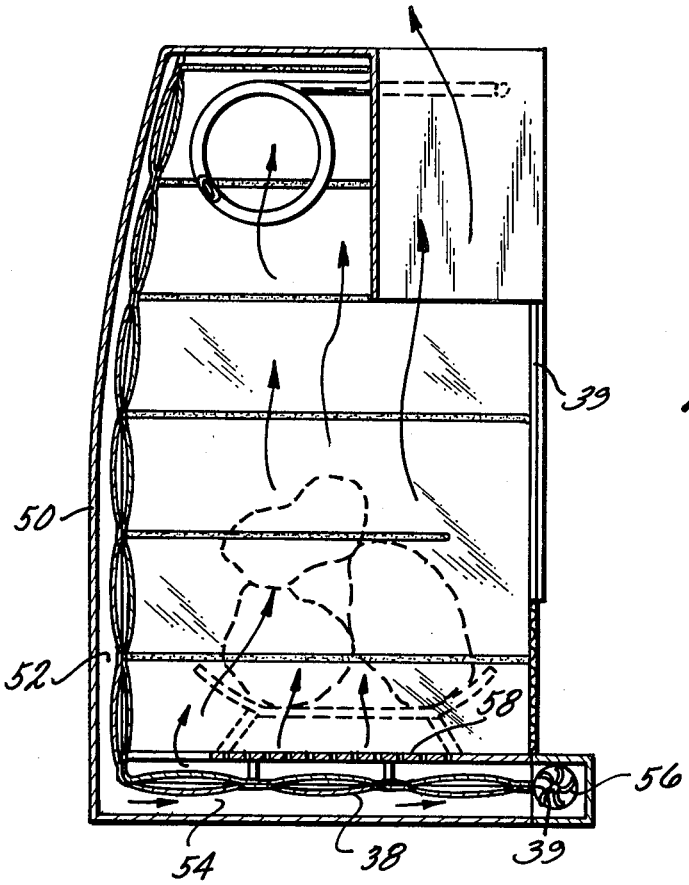
FIG. 4
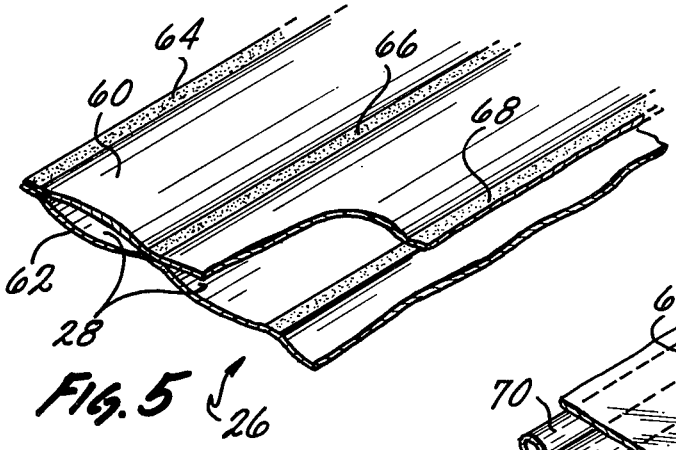
FIG. 5
FIG. 5A
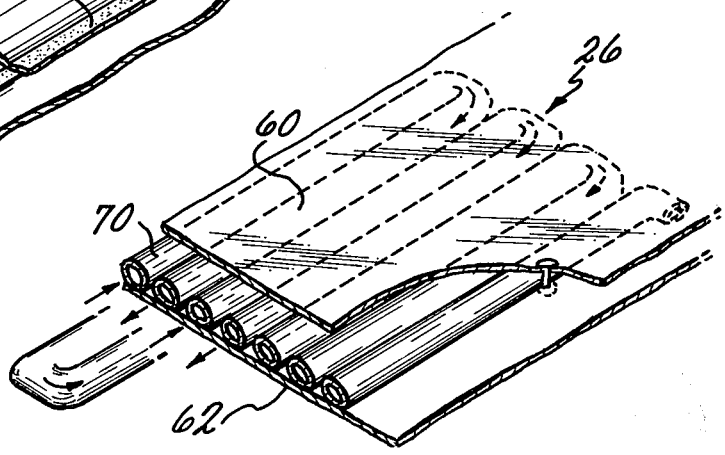

WATER HEATER FOR USE IN FIREPLACE

This is a continuation of application Ser. No. 059,686, filed July 23, 1979, now abandoned.

BACKGROUND OF THE INVENTION

1. Field of the Invention

The present invention is in the field of water heaters and more particularly relates to a water heater for use in a fireplace in a home.

2. The Prior Art

In U.S. Pat. No. 3,394,697 issued July 30, 1968, Lewis shows a free-standing firescreen having a central section to which two side sections are joined at angles. The fireliner is placed adjacent a fireplace with the smooth, flat sides of the sections facing the fire. On the opposite side of the fireliner, copper tubing is arranged in a serpentine path, and water to be heated is circulated through the tubing.

The inventions disclosed in U.S. Pat. No. 2,046,051 issued June 30, 1936 to Baruch et al., and in U.S. Pat. No. 4,025,043 issued May 24, 1977 to Cleer, Jr. are generally similar and include water-filled fireplace liners having water-filled floor members. These devices fit into the fireplace cavity and the fire is located within the device. In all of the prior art discussed to this point, a large portion of the heat produced by the fire flows upwardly through the device into a flue which conducts it into the atmosphere.

In British patent specification No. 930,937 published July 10, 1963, Green shows a fireplace in which a hollow water-filled wall is positioned behind and above the fire so that the hot gases come in contact with the front surface of the wall. Green also provides a lower flue passage which leads rearwardly from the fire beneath the water-filled wall and then upwardly along the rear surface of the wall. Green discloses that some of the heated air passes into the lower flue beneath the water-filled wall and thereafter flows upwardly along the rear surface of the water-filled wall to warm it. To the extent that the heated air divides, some of it passing on the front side of the water-filled wall, and the remainder passing on the rear side of the water-filled wall, the invention is little different from merely placing a boiler in the flue so that some of the heated air passes on each side of the boiler.

As will be seen below, the present invention includes structural features which render it more efficient for heating water than any of the above-described prior art.

SUMMARY OF THE INVENTION

The water heater of the present invention achieves a greater thermal efficiency than units known in the prior art because of its structural arrangement which includes a vertically-extending heat exchanger which sits in the fireplace behind the fire. Some of the hot air rising from the fire is captured and prevented from going up the chimney by a removable hood-like heat trap which surrounds, but is spaced from, the top portion of the heat exchanger. The heat trap serves to guide the flow of heated air rearwardly over the top of the heat exchanger, then downwardly along the rear side of the heat exchanger. In a preferred embodiment, the downwardly flowing hot air is permitted to escape under the lower edge of the heat trap, whereupon the air is then drawn upward into the chimney.

In another embodiment, the hot air flowing downwardly along the rear side of the heat exchanger is ducted to a plenum which extends beneath the fire and which contains a portion of the heat exchanger. That portion of the heat exchanger extends parallel to the floor plane, and its upper side is heated by the fire while its lower side is heated by the flow of hot air through the plenum.

In other embodiments, the structure of the heat exchanger is more complicated than discussed above. In one embodiment, the heat exchanger includes side panels as well as a back panel. In other embodiments, the heat exchanger includes more than one back panel, which are supported in spaced parallel relationship. In other embodiments, an auxiliary fan is used to supplement the normal flow of air through the passages adjacent the heat exchanger, and in still other embodiments, auxiliary ducts are used to control the flow of air.

All of the embodiments are characterized by the use of a heat trap which prevents an appreciable portion of the hot air from the fire from going up the chimney, and which redirects the flow of heated air downwardly over the rear side of the heat exchanger, so that the front part of the heat exchanger is heated directly by the fire, while the rear side of the heat exchanger is heated by exposure to the downwardly flowing hot air.

The novel features which are believed to be characteristic of the invention, both as to organization and method of operation, together with further objects and advantages thereof, will be better understood from the following description considered in connection with the accompanying drawings in which a preferred embodiment of the invention, as well as several alternative embodiments, are illustrated by way of example. It is to be expressly understood, however, that the drawings are for the purpose and illustration only, and are not intended as a definition of the limits of the invention.

BRIEF DESCRIPTION OF THE DRAWINGS

FIG. 4 is a side cross-sectional view of a modified version of the preferred embodiment shown in FIG. 2;

FIG. 5 is a fractional perspective view of a portion of the heat exchanger used in a preferred embodiment of the invention;

FIG. 5*a* is a fractional perspective view of the heat exchanger in an alternative embodiment;

DETAILED DESCRIPTION OF THE PREFERRED EMBODIMENT

Figure 1:
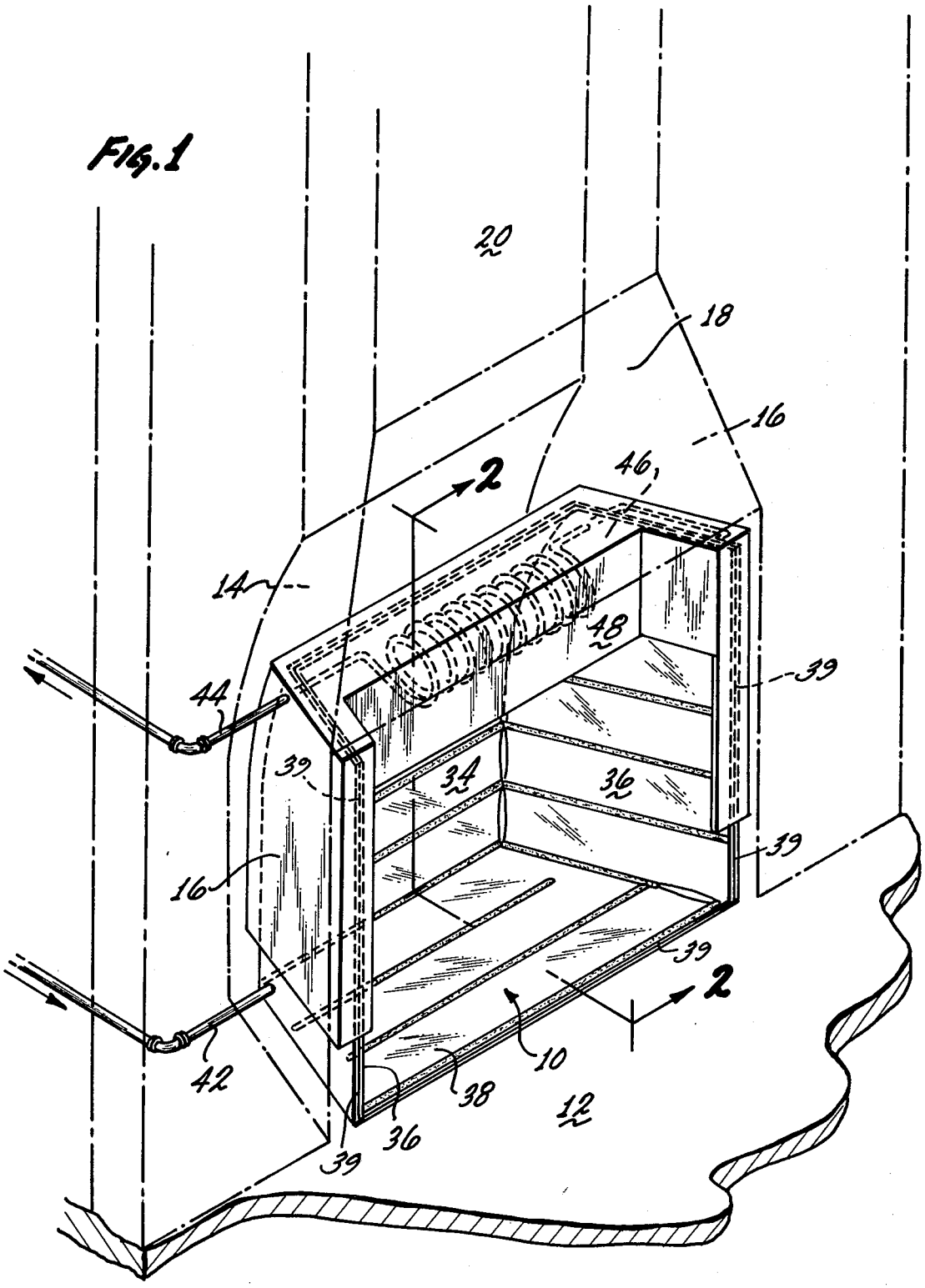
FIG. 1 is a perspective view showing a preferred embodiment of the water heater of the present invention installed in a fireplace.

Turning now to the drawings, in which like parts are denoted by the same reference numeral throughout, there is shown in FIG. 1 a preferred embodiment of the water heater of the present invention. As will become clear, the water heater may be, and normally is, installed in a preexisting fireplace in a building, and the structure of the building is indicated by the dashed lines in FIG. 1. The fireplace normally includes a floor plane 12 from which a back wall 14 and side walls 16 extend upwardly to define between them a space for a fire. A front wall 18 is spaced from the floor to provide access to the fire, and the front wall 18 merges with the side walls 16 and the back wall 14 to form a flue 20 above the fire through which rising smoke and hot gases are conducted away from the fireplace.

Figure 2:
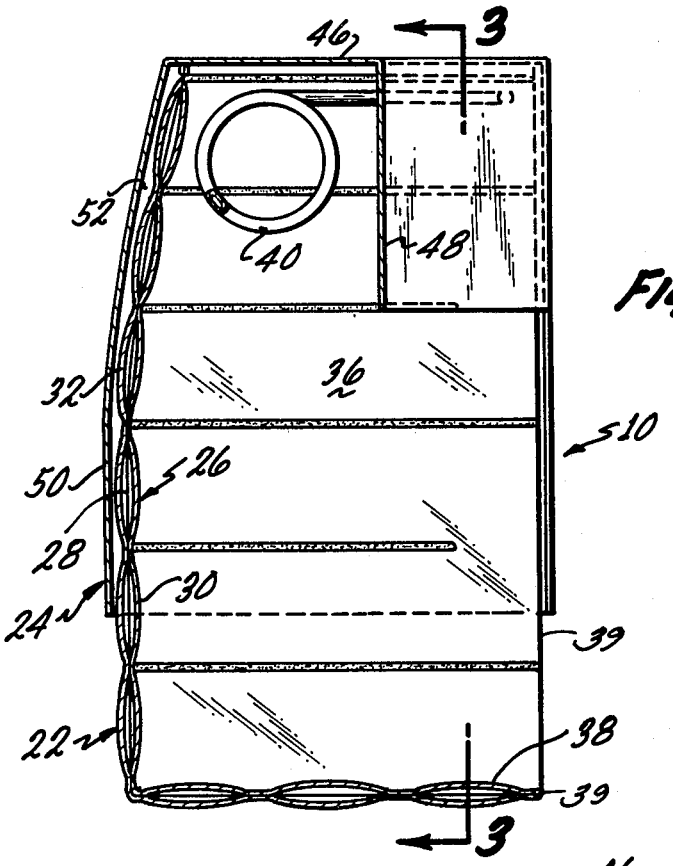
FIG. 2 is a side cross-sectional view in the direction 2—2 of FIG. 1.

Referring now to the embodiment shown in FIGS. 1-5, the water heater 10 of the present invention includes a heat exchanger 22 and a removable heat trap 24 which sits on and partially covers the heat exchanger 22. The heat exchanger 22 includes a wall 26 having an internal passage 28 through which water may flow. The first side 30 of the wall faces the fire, and the second side 32 of the wall faces away from the fire. In the preferred embodiment shown in FIGS. 1-5, the wall 26 further includes a back portion 34, and side portions 36 which extend at angles from the back portion. The heat exchanger 22 further includes a floor portion 38, which rests on the floor plane in the embodiment of FIGS. 1-5. As illustrated in FIGS. 1 and 2 and 4 of the drawings, each of the side portions 36 and the floor portion 38 extend frontally from the back wall 34 and terminate in a front edge 39 forwardly of the short wall 48. The heat exchanger 22 further includes a section of tubing 40 supported near the upper portion of the heat exchanger. The passages in the back portion 34, the side portion 36, the floor portion 38, and the tubing 40 are connected to communicate with each other, and together constitute a watertight passage 28 through which water may be driven for the purpose of heating the water. The water is supplied to the heat exchanger through an inlet tube 42 and is discharged from the heat exchanger through an outlet tube 44. In the preferred embodiment, water is supplied to the inlet tube 42 from a water supply pipe (not shown) and the heated water discharged through the outlet tube 44 may be stored in a reservoir (not shown).

The heat trap 24 includes a top wall 46 which is spaced vertically above the heat exchanger 22, and which does not open directly into the flue. From the top wall 46 of the heat trap 24, a short wall 48 depends in front of the top portion of the wall 26 of the heat exchanger 22, in front of the first side 30 of the wall 26 of the heat exchanger 22. Long walls 50 also depend from the top wall 46, and the long walls 50 are disposed along but spaced from those portions of the wall 26 of the heat exchanger not facing the fire. The long walls 50 are joined to form a skirt which generally extends around those parts of the back portion 34 and the side portions 36 which do not face the fire. The skirt formed by the long walls 50 does not extend to the floor in the embodiment shown in FIG. 1-3. Thus, a space 52 is defined between the second side 32 of the wall and the long walls 50 of the heat trap 24.

Figure 3:
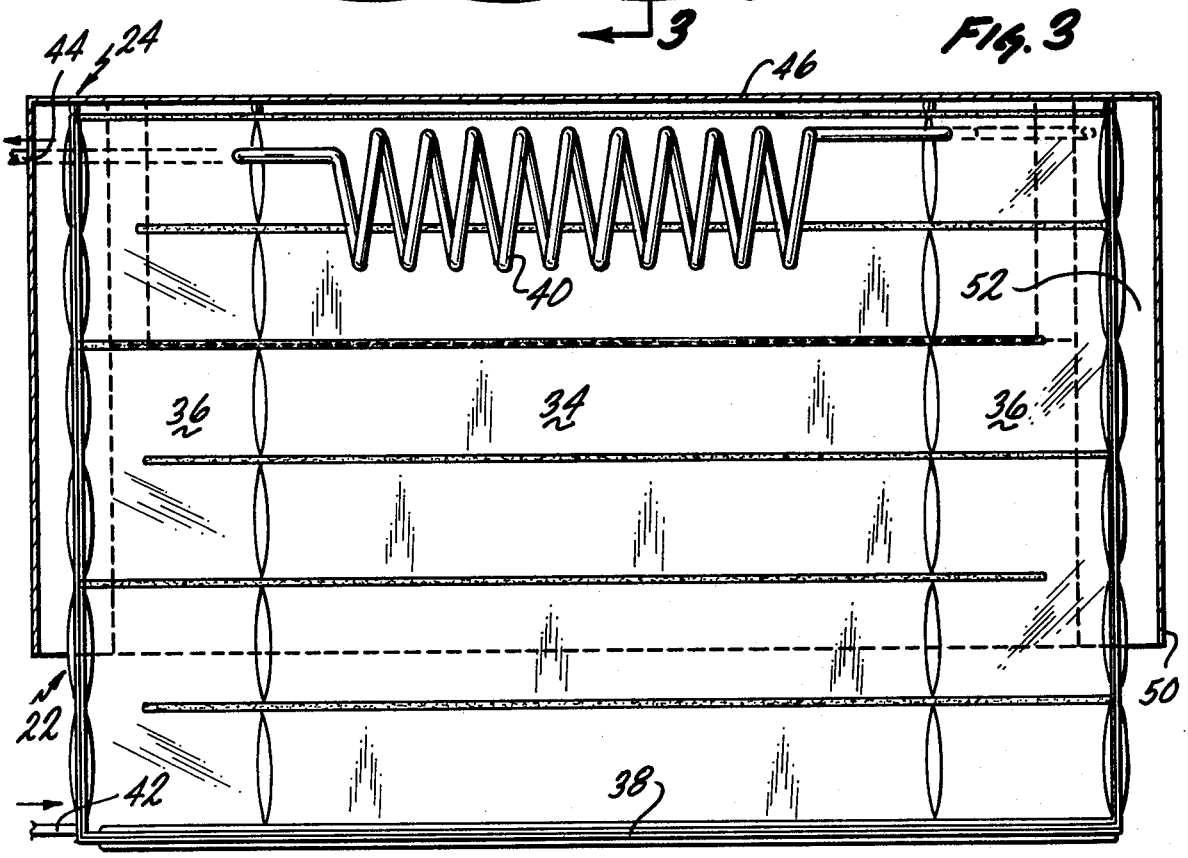
FIG. 3 is a front cross-sectional view in the direction 3—3 of FIG. 2.

In the embodiment of FIGS. 1-3, some of the hot air and smoke given off by the fire passes upwardly in front of the short wall 48 and is captured by the front wall 18 of the fireplace which guides the hot air into the flue 20. Another part of the hot air generated by the fire passes on the rear side of the short wall 48 and is captured within the heat trap 24. Because of its heat, this air has a tendency to rise, and in doing so passes over the tubing 40, heating it and the water inside of it. Thereafter, the heated air passes rearwardly over the top of the wall 26 and is drawn downwardly through the space 52 by the draft of the chimney. While passing through the space 52, the hot air heats the second side 32 of the wall 26, so that much of the residual heat of the air is used in the present invention for a useful purpose, namely, heating the water. The downwardly moving air escapes from the space 52 at the lower edge of the long walls 50, and thereafter, the discharged air is drawn upwardly into the flue 20 by the draft of the chimney. Thus, the first side 30 of the wall 26 is heated both by radiation from the fire and by the passage of heated air over it. And the second side 32 of the wall 26 is heated by the downward passage of heated air over it. The water in the floor portion 38 of the heat exchanger 22 is warmed mainly by radiation in the embodiment of FIGS. 1-3.

In another embodiment, shown in FIG. 4, there is provided a plenum which encloses the floor portion 38 of the heat exchanger 22. The long walls 50 of the heat trap 24 extend to the plenum 54 so that the space 52 opens into the plenum 54. In the embodiment of FIG. 4, a fan 56 is provided at the front end of the plenum to cause the air descending downwardly in the space 52 to move horizontally and forwardly beneath the lower surface of the floor portion 38 to the front of the plenum 54, and thence rearwardly over the top of the floor portion 38, to be discharged through the perforate upper wall 58 of the plenum 54, as shown by the arrows in FIG. 4.

FIG. 5 shows the construction of the wall 26 in a preferred embodiment of the invention. The wall 26 includes two opposed panels 60, 62 which are joined along predetermined lines 64, 66, 68 to define a passage 28 between the panels. The passages 28 may be sealed off at their ends and may be joined to permit water to flow from one passage to another.

FIG. 5*a* shows the structure of the wall in an alternative embodiment. In that alternative embodiment, the wall 26 includes two panels 60, 62 between which there is sandwiched a tube 70 which follows a tortious path between the panels 60, 62. The panels 60, 62 are bonded to or otherwise affixed to the tube 70.

In all of the embodiments, the preferred material for the heat exchanger is copper, although any material having a relatively high conductivity may be used. Although the present invention is referred to as a water heater because that is the principal used envisioned for it, it is considered obvious that the present invention can be used for the heating of liquids other than water and for the heating of other fluids, including air.

Figure 6:
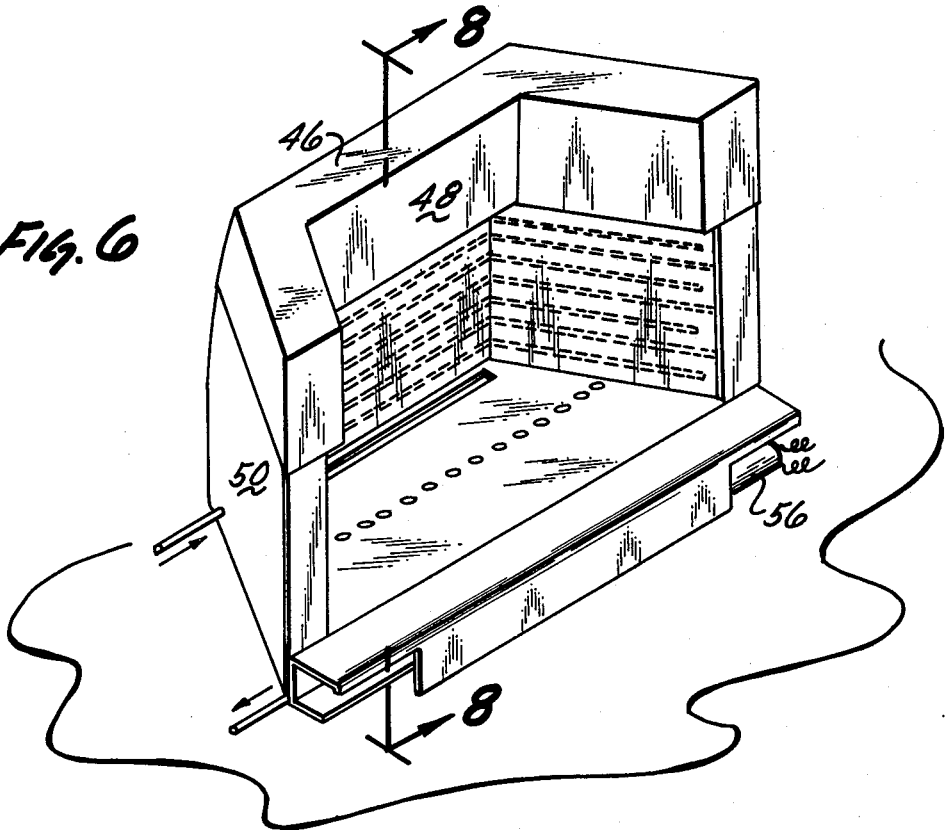
FIG. 6 is a perspective view of a second embodiment of the water heater according to the present invention.
Figure 8:
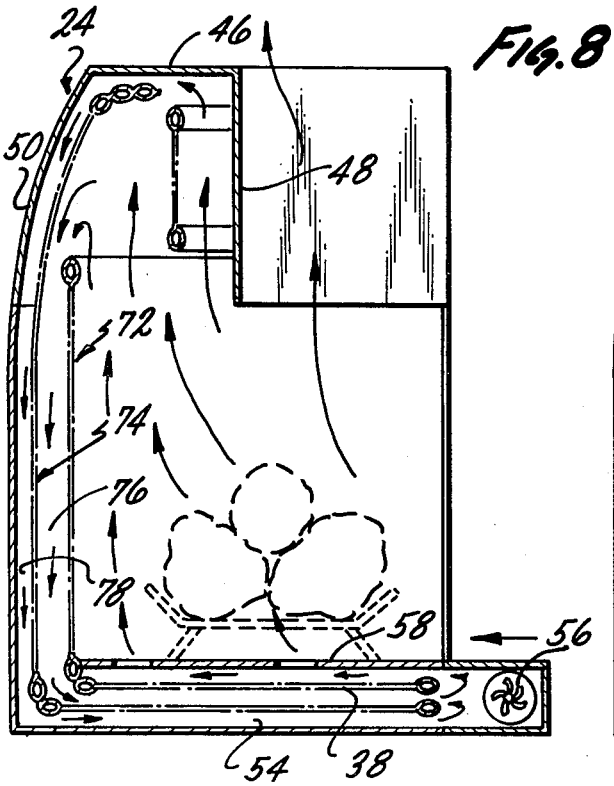
FIG. 8 is a cross-sectional view in the direction 8—8 of FIG. 6.
Figure 7:
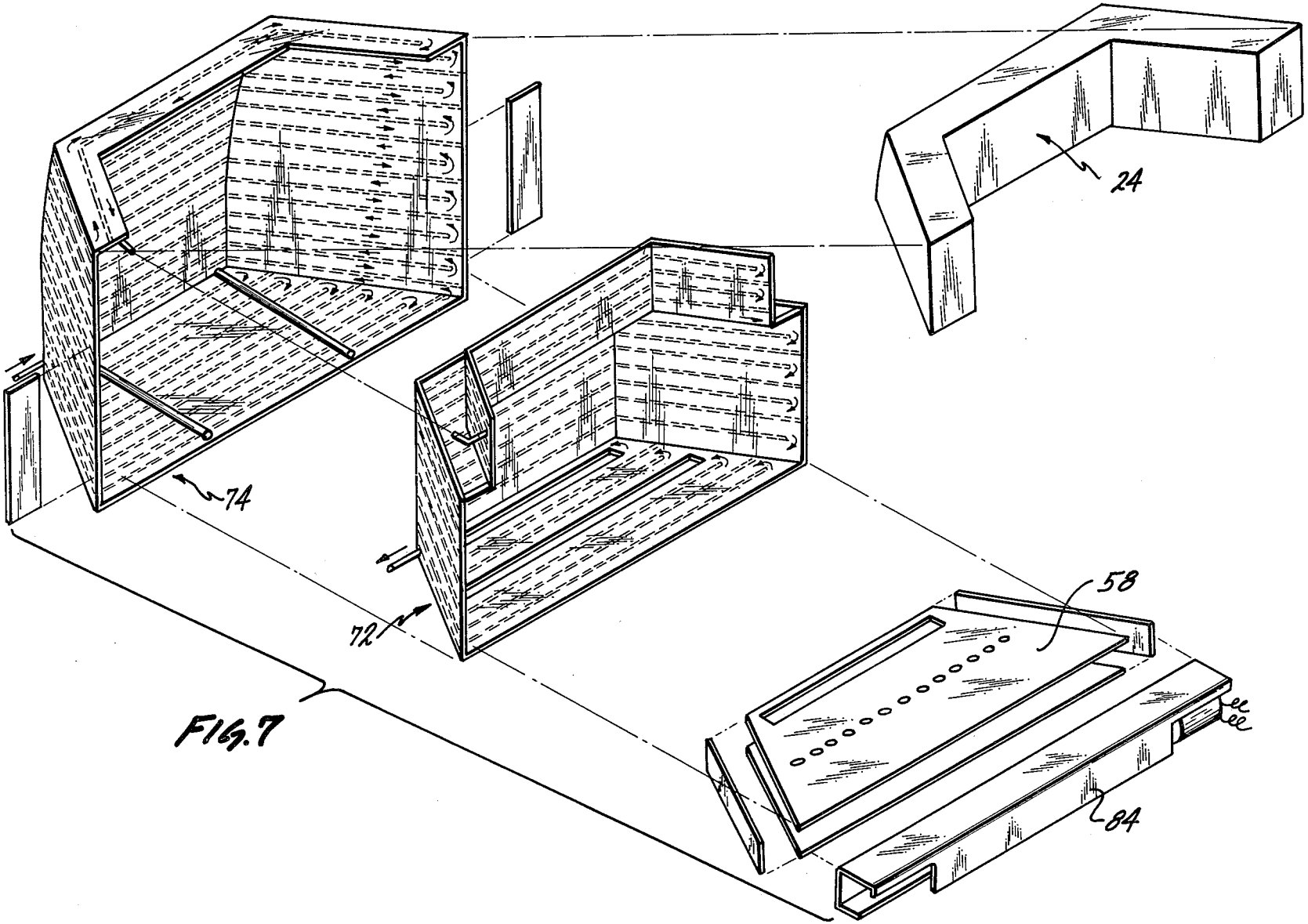
FIG. 7 is an exploded view of the water heater of FIG. 6.

FIGS. 6-8 relate to a second preferred embodiment of the invention, in which the heat exchanger 22 has a more elaborate structure adapted to extract from the heated air a greater fraction of the heat than is possible in the embodiments discussed thus far. In the second preferred embodiment shown in FIGS. 6, 7, and 8, this desirable result is accomplished by the use of a heat exchanger which includes a first part 72 stacked within a second part 74. Comparing the embodiment of FIG. 8 with the embodiment of FIG. 4, it is seen that the second part 74 of the heat exchanger occupies some of the space 52 between the first part 72 and the long walls 50 of the heat trap, as well as the space within the plenum 54 lying below the floor portion 38 of the first part 72. As indicated by the arrows in FIG. 8, some of the air heated by the fire is trapped by the heat trap 24 and passes rearwardly over the top of the first part 72 as well as rearwardly over the top of the second part 74.

The hot air then is drawn downwardly behind the first part 72 and behind the second part 74 to the plenum 54 by a fan 56, the air being discharged from the plenum through the perforate upper wall 58 of the plenum. In this way, the downwardly flowing air in the space 76 heats both the rear side of the first part 72 of the heat exchanger as well as the front side of the second part 74 of the heat exchanger, while the downwardly flowing hot air in the space 78 heats the rear side of the second part 74 of the heat exchanger.

Figure 9:
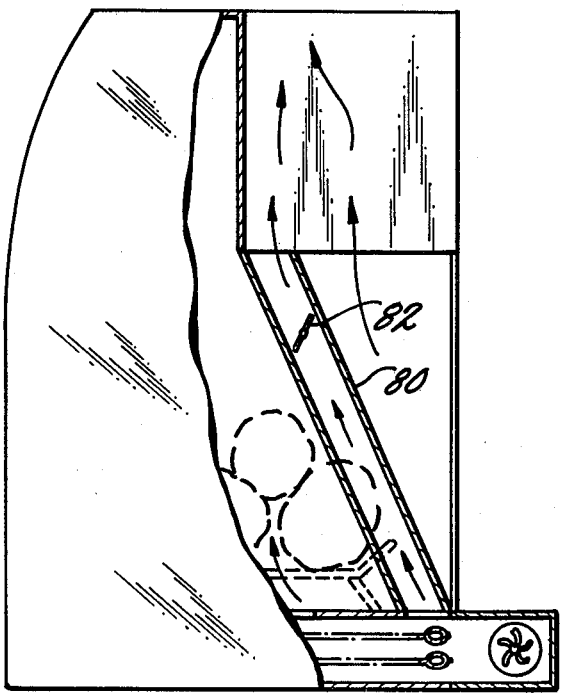
FIG. 9 is a cross-sectional side view of another embodiment of the water heater of the present invention.

FIG. 9 shows another embodiment, generally similar to that shown in FIG. 8, but differing in that a duct 80 is provided to connect the plenum 54 with the flue 20. The duct 80 thus permits the air from the plenum 54 to by-pass the fire to prevent the fire from becoming excessively hot when certain types of fuel are burned. A damper 82 may be provided to alter the rate of flow of air through the duct 80.

In the embodiments of FIGS. 6–9, the fan 56 is mounted on a housing 84 which forms the front end of the plenum 54. This facilitates assembly and maintenance, although alternative structural expedients are conceivable.

It is also conceivable that the use of the fan 56 may prove unnecessary in certain installations, while in other installations it may prove preferable to mount an exhaust fan in the chimney or on the roof.

Although copper is the preferred material for use in the heat exchanger, it is not necessary that the heat trap 24 be made of copper.

The precise location of the tubing 40 within the heat trap 24 is not critical, and in alternative embodiments, the tubing 40 may be dispensed with altogether.

And thus, there has been described a fireplace uniquely adapted for the efficient heating of water and characterized in that a heat trap is employed above the heat exchanger to capture some of the hot air heated by the fire and to route some of that hot air rearwardly over the top of the heat exchanger and downwardly behind the heat exchanger so as to heat the backside of the heat exchanger which does not face the fire.

The foregoing detailed description discloses several embodiments of the invention, and it is to be understood that additional embodiments thereof will be obvious to those skilled in the art. The embodiments described herein, together with those additional embodiments are considered to be within the scope of the invention.

What is claimed is:

1. A water heater for use in a fireplace of the type including a back wall and side walls extending upwardly from a floor plane to define a space for a fire, and including a front wall spaced from the floor plane and merging with the back wall and side walls to form a flue above the fire into which rising smoke and hot gases are drawn by a draft, said water heater comprising in combination:

a heat exchanger having a wall including a passage for water, the wall being inclined to the floor plane and so positioned within the fireplace that a first side of the wall faces the fire while a second side of the wall faces away from the fire, said heat exchanger further including a floor portion extending substantially parallel to the floor plane of the fireplace and having a passage communicating with the passage of the wall of said heat exchanger;

a plenum extending beneath said floor portion;

a heat trap having a top wall spaced vertically above said heat exchanger, a short wall depending from the top wall below the top of the wall of said heat exchanger and in front of the upper portion of the first side of the wall of the heat exchanger into the space above the fire so that some of the smoke and hot gases rise into the space between the short wall and said heat exchanger, and further including long walls depending from the top wall to form a skirt partially surrounding and spaced from those portions of the wall of said heat exchanger not facing the fire, said skirt extending downwardly to said plenum;

said plenum opening into the space between said skirt and said exchanger, and opening into the space for the fire above said floor portion; and, fan means associated with said plenum for drawing the smoke and hot gases, that have risen from the fire into said heat trap, over the top of the wall of said heat exchanger and downwardly along the second side of the wall of said heat exchanger thereby imparting heat to the second side of the wall of said heat exchanger, for drawing into the plenum smoke and hot gases from the space between said skirt and said heat exchanger and for driving the smoke and hot gases drawn into the plenum into the space above the floor portion.

2. The water heater of claim 1 wherein said heat exchanger further comprises a second wall generally parallel to said wall, disposed between and spaced from said wall and said shirt, and having a passage communicating with the passage of the said wall.

3. The water heater of claim 1 wherein said heat exchanger further comprises a second floor portion generally parallel to said floor portion, disposed within said plenum below and spaced from said floor portion, and having a passage communicating with other passages of said heat exchanger.

4. The water heater of claim 1 further comprising duct means connected to said plenum for conveying smoke and hot gases from said plenum to the space for the fire.

* * * * *